United States Patent [19]

Ciccotelli

[11] Patent Number: 4,657,515

[45] Date of Patent: Apr. 14, 1987

[54] SWIM FIN

[76] Inventor: Stephen S. Ciccotelli, Box 1414, Deming, N. Mex. 88031

[21] Appl. No.: 798,676

[22] Filed: Nov. 15, 1985

[51] Int. Cl.[4] ..... A63B 31/08

[52] U.S. Cl. ..... 441/64

[58] Field of Search ..... 441/60–64

[56] References Cited

U.S. PATENT DOCUMENTS 3,302,223 2/1967 Ciccotelli ..... 441/64

3,665,535 5/1972 Picken ..... 441/64

FOREIGN PATENT DOCUMENTS 1245395 9/1960 France ..... 441/64

676938 11/1964 Italy ..... 441/64

*Primary Examiner*—Joseph F. Peters, Jr.

*Assistant Examiner*—Jesûs D. Sotela

*Attorney, Agent, or Firm*—William J. Ruano

[57] ABSTRACT

A swim fin having a foot pocket and two flexible beams projecting directly forwardly from the sides of the toe of the foot pocket. A rigid blade is attached to the flexible beams so that a space exists between it and the foot pocket. The elements which are provided to attach the two flexible beams to the rigid blade include a pivot point for the rigid blade. The swim fin is simple in design and is designed for maximum efficiency, comfort and reliability.

2 Claims, 3 Drawing Figures

SWIM FIN

The present invention relates to improvements in swim fins and its principal objective is to provide a swim fin with greater efficiency.

SUMMARY OF THE INVENTION

A further object of the invention is to provide a suspension system for attaching a rigid blade to the flexible beams which resists twisting in a torsional direction even though the blade is positioned so that a large space exists between the foot pocket and the blade; which allows the flexible beams to flex naturally; which maintains the pivot point of the blade near the foot pocket; which permits the blade to be angled to a greater extent than is possible in the conventional swim fin without decreasing the ability of the swimmer to walk or stand while wearing the fins; which permits the blade to reverse its blade angle easily at the end of each stroke, but resists excessive deflection on a hard kick by the swimmer; and finally, which protects the blade from damage when the swimmer is walking with the fins.

Further objects and advantages of my invention will appear as the specification proceeds.

BRIEF DESCRIPTION OF THE DRAWING

The preferred form of my invention is illustrated in the accompanying drawing in which.

Figures 1, 2, 3:
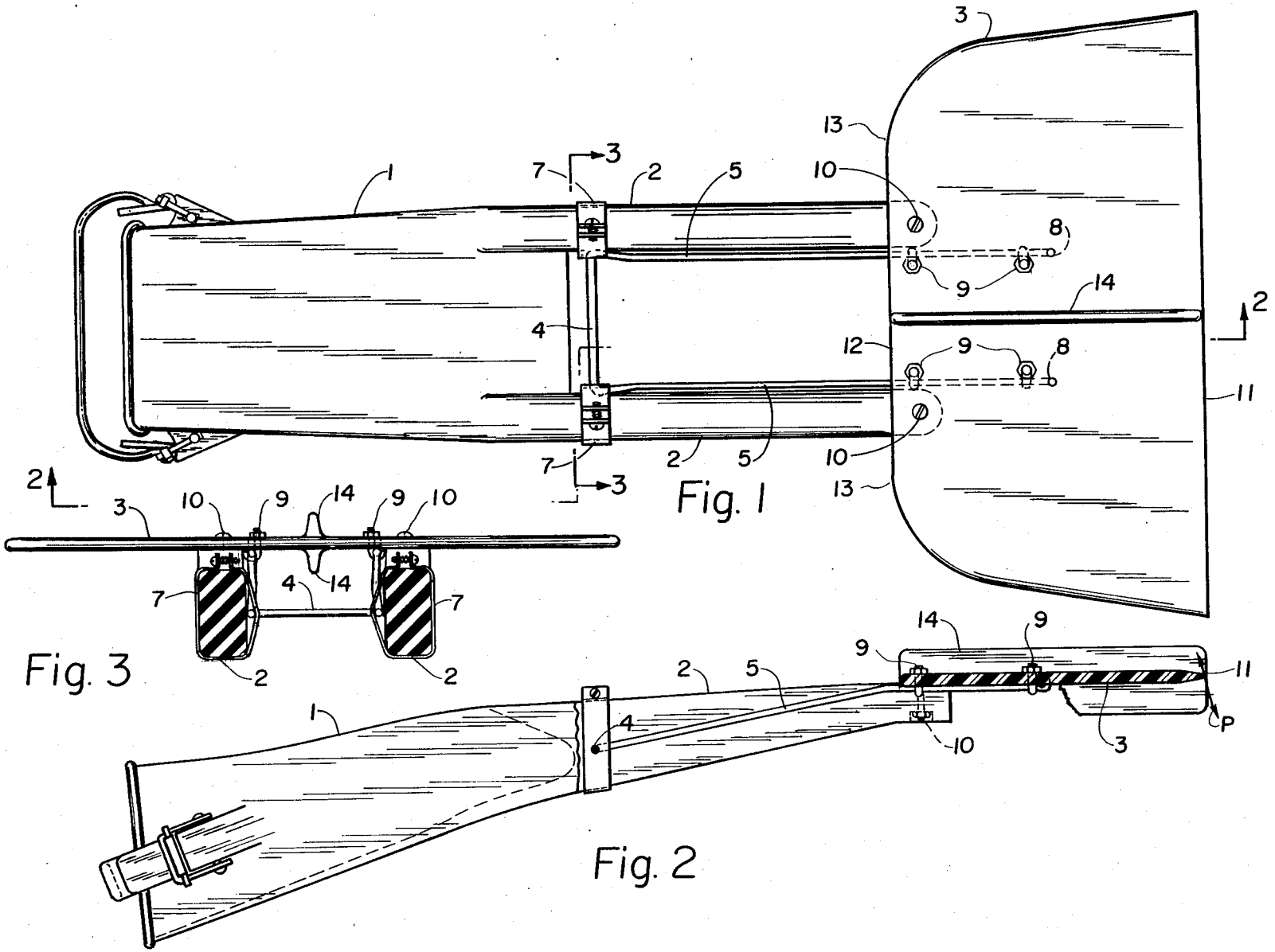
FIG. 1 is a plan view of my swim fin.
FIG. 2 is a side view of same with a partial sectional view taken at line 2—2 of FIG. 1.
FIG. 3 is a section taken at line 3—3 of FIG. 1.

While I have shown the preferred form of my invention, I wish to have it understood that various changes or modifications may be made within the scope of the claims hereto attached, without departing from the spirit of the invention.

DESCRIPTION OF THE PREFERRED EMBODIMENT

Referring to the drawings in detail, my swim fin comprises a foot pocket 1 with two flexible beams 2 projecting from the toe of the foot pocket, and a rigid blade 3 attached to the ends of the flexible beams. The rigid blade has two struts 5 that project from the blade. Clamped around each flexible beam near the toe of the foot pocket is a band 7 with a clearance hole for a hinge pin 4. The hinge pin 4 and the two struts are made as a one piece U-shaped wire form, and the ends of the struts are bent 90 degrees so that they can be inserted into holes 8 in the blade. The wire form passes through the clearance hole in each band and the bands are positioned at the two corners of the U-shaped wire form and clamped around the flexible beams at a point near the toe of the foot pocket. The struts are clamped to the blade with hook-shaped fasteners 9 illustrated in FIG. 3. Near the end of each flexible beam, there is a hole for a fastener, and in the blade there is a matching hole. The ends of the flexible beams are attached to the blade with fasteners 10.

The operation of my swim fin is as follows:

Referring to FIG. 2, during swimming the trailing end of the blade 11, deflects alternately in one direction and then in the other describing an arc-shaped path P, illustrated in FIG. 2, having its center at the hinge pin 4. Since the blade-wire form assembly is attached to each flexible beam at only two points; namely, near the toe of the foot pocket and at a point near the end of the flexible beam, the flexible beam is free to flex between these two points. Because the hinge pin of the wire form is attached to the flexible beams at a point near the toe of the foot pocket and consequently where the flexible beams are stiffest, the blade has excellent resistance to twisting even though a large space exists between the foot pocket and the blade.

In the conventional swim fin, because the blade is flexible, the center part of the blade cups during swimming. This cupping action provides stability and prevents lateral sliding of the blade, but since the blade in my swim fin is rigid, no cupping takes place and stability is achieved by blade design alone. These are the design points for the blade that provide stability:

1. The trailing end of the blade 11 is the widest part of the blade.
2. A stabilizer surface 14 is located in the center of the blade.
3. The corners 13 at the leading end of the blade are rounded. This increases efficiency as well as stability.
4. The size of the blade progressively increases from the rounded corners to the trailing edge.

Since the blade is mounted over the ends of the flexible beams, much of the blade is off the ground when the swimmer is standing or walking while wearing the fins. This reduces possible damage to the blade.

As previously stated, the principal object of this invention is to provide a swim fin with greater efficiency. This is achieved by incorporating in the swim fin the following design points:

1. The blade is rigid and is made of material such as plastic.
2. The blade is positioned so that a large space exists between the foot pocket and the leading end of the blade. This location for the blade is important to the efficient operation of the blade because it avoids the turbulence that is directly behind the foot pocket. Also, this location for the blade contributes to efficiency in another way—since the blade angle of a swim fin must reverse itself at the end of each stroke, considerable energy is expended by the conventional swim fin because of the drag caused by the blade surface near the toe of the foot pocket during blade angle reversal at the end of each stroke. For this reason in my swim fin, I have eliminated this surface.
3. Another design point that contributes to efficiency is the fact that only two flexible beams are used and that they project directly ahead from the foot pocket. This is in contrast to the conventional swim fin in which the main flexible beams are attached to the sides of the foot pocket and fan out to the sides of the blade resulting in reduced efficiency because the flexible beams interfere with the entry of water to the blade. Also, this construction requires a small web between the flexible beam and the sides of the foot pocket. This web causes drag during blade angle reversal.
4. Some further gain in efficiency is achieved by angling the blade more than is possible in the conventional swim fin without reducing the ability of the swimmer to stand or walk while wearing the fins. This is possible because the blade is mounted over the ends of the flexible beams. In my swim fin, the greater angle positions the blade closer to the desirable blade angle in which, during swimming, the blade deflects about as much on the up stroke as on the down stroke.
5. The two corners at the leading end of the blade are rounded and the stabilizer surface is located in the center of the blade. This construction reduces entry losses to the blade.

6. The size of the blade when measured along the trailing edge is greater than the dimension of the blade when measured along its center. This proportion contributes to efficiency.

7. And finally, the suspension system contributes to efficiency by permitting the blade to reverse itself easily at the end of each stroke, but resists excessive blade deflection on a hard kick.

While I have illustrated a simple flat blade in the drawings, I wish to have it understood that the blade cross-section may be made streamlined to reduce drag without departing from the spirit of the claims.

I claim:

1. In a swim fin, a foot pocket, two flexible beams projecting forwardly along the sides of the foot pocket, a rigid blade, means to attach the ends of the flexible beams to the rigid blade; a U-shaped wire form, means to attach the corners of the wire form to the flexible beams at a point near the foot pocket, and means to attach the ends of the wire form to the rigid blade.

2. In a swim fin as recited in claim 1, wherein said means to attach the ends of the flexible beams to the rigid blade comprises a hole for a fastener located near the extremity of each of the said flexible beams, a matching hole in the said rigid blade and two fasteners to attach the ends of the said flexible beams to the said rigid blade, wherein said means to attach the corners of said wire form to the said flexible beams comprises two bands having a clearance hole in each of them which the wire form passes through, each of said bands being located at a corner of the said wire form and being clamped around a flexible beam at a point near the foot pocket, and wherein said means to attach the ends of the said wire form to the said rigid blade comprises six holes in the rigid blade, the ends of the wire form for a distance equal to the thickness of the blade being bent 90 degrees, the ends of the wire form being inserted into the two holes located nearest the trailing edge of the rigid blade and four hook shaped fasteners in the four remaining holes to clamp the wire form to the rigid blade.

* * * * *